United States Patent [19]

Capri et al.

[11] Patent Number: 4,655,461

[45] Date of Patent: Apr. 7, 1987

[54] GAME BOARD APPARATUS UTILIZING A LOTTERY PRINCIPLE

[75] Inventors: Albert Capri, Vincentown; Samuel C. Capri, Edgewater Park, both of N.J.

[73] Assignee: Games 'n Things Inc., Vincentown, N.J.

[21] Appl. No.: 612,610

[22] Filed: May 21, 1984

[51] Int. Cl.[4] ..... A63F 3/00; A63F 3/06; A63B 71/00

[52] U.S. Cl. ..... 273/249; 273/269; 273/144 A

[58] Field of Search ..... 273/248, 249, 269, 273, 273/274, 138 A, 138 R, 144 B, 144 R

[56] References Cited

U.S. PATENT DOCUMENTS 626,853 6/1899 Boig ..... 273/274
2,026,082 10/1935 Darrow ..... 273/256

OTHER PUBLICATIONS

Scarne, *Scorne's New Complete Guide to Gambling*, pp. 490–492, a publication is furnished by Group 330.

*Primary Examiner*—Leo P. Picard
*Assistant Examiner*—Benjamin Layno
*Attorney, Agent, or Firm*—Charles F. Duffield

[57] ABSTRACT

A game board apparatus of chance is disclosed and includes a game board having a path formed as a series of stations between a starting station and a finishing station and a plurality of stations along which player pieces are moved from station to station. The game further includes a container having forty consecutively numbered balls, a ball placement board, a plurality of chips in the form of coins, a plurality of instruction cards, and a plurality of cards in the form of lottery tickets. Each lottery ticket has spaces bearing numbers from one through forty and two sets wherein one set has three blank spaces and the other set has four blank spaces. During play the players begin at the starting point and are each given a lottery ticket. Each player then selects six lottery ticket numbers from the spaces numbered from one through forty, three single digit numbers and four single digit numbers are also chosen and marked on the blank spaces. The balls are then randomly drawn from the container and the players move as their selected numbers are drawn. Playing draw instruction cards as their player piece or marker falls upon certain pre-selected stations.

11 Claims, 8 Drawing Figures

GAME BOARD APPARATUS UTILIZING A LOTTERY PRINCIPLE

BACKGROUND OF INVENTION

The present invention relates to board games and, more particularly, to a board game which utilizes as a fundamental element therein the concept of a lottery.

Many states are now operating state lotteries and a high interest in the general public has arisen in lotteries.

A fundamental shortcoming is present in most all multiple player games in that during a given round of play only a single player is involved while the remaining players must wait their turn. There is a need for a game in which all players participate in each round.

The board game of the present invention appeals to the high public interest in lotteries and also provides a game in which each player participates in every round.

SUMMARY OF INVENTION

The game board of the present invention utilizes a game board which has a progressive path formed of a series of stations between a starting position and a finish position. A plurality of player markers are utilized and are moved along the game board from the starting position along the stations to the finish position in accordance with the rules of play of the game.

A plurality of player chips representing token money are provided. At the beginning of the game the player chips are provided to the players in a given quantity.

A plurality of player instruction cards, in accordance with the rules of play, are taken by the respective players upon the occurrence of certain play conditions such as a player marker reaching a station having a designation thereon that the player is to take a card sequentially from the deck of instruction cards. The player then follows the instructions on the card such as to advance an additional station, pay other players a certain number of coins, etc.

Forty sequentially numbered balls are provided. These balls are maintained in a container and during play are randomly drawn from the container one at a time. A ball retaining board is provided with retaining recesses numbered one through forty into which the balls are placed as they are sequentially drawn.

The game further includes a plurality of lottery cards which are purchased by each player. The lottery cards include blocks numbered one through forty and two blanks one of three blocks and one of four blocks.

During play each player places his player marker at the start position, the instruction cards are shuffled and placed on the playing board and each player purchases a lottery ticket for a prescribed number of player chips which are then placed into a lottery pool.

Each player then selects six numbers from the forty numbers on the lottery ticket. Each player then also chooses three numbers for the three blank blocks and four numbers for the four blank blocks. The forty sequentially numbered balls are then placed into the ball container, shaken and then play begins. The numbered balls are drawn one at a time randomly from the ball container. The number is read aloud and the ball placed into the appropriate numbered ball recess of the ball containing board. Each player then checks his lottery ticket to determine whether the number read was selected on his lottery ticket in either the six chosen numbers, the three blanks completed or the four blanks completed.

If the number drawn from the ball container is one of the three selected numbers or four selected numbers the player will collect from the lottery pool a like number of chips respectively. If the number drawn from the ball container is one of the six numbers chosen of the forty preprinted numbers on the lottery ticket, then the player will advance one station.

The game board is appropriately marked in various stations with an indication such as a star. When a player advances to a station having a star, then the player draws a player direction card from the top of the direction card stack. The direction cards contain various instructions which the player follows. The directions can direct that the player advance one or more stations, return one or more stations and/or pay or receive player chips from the lottery pool or other players.

When all six numbers selected by a player on his lottery ticket have been drawn from the lottery ball container, then the player so declares having won that round of the lottery. The winning player then collects all of the player chips from the lottery pool. All players then discard their lottery tickets and purchase new lottery tickets and the lottery balls are returned back to the lottery ball container and a further round of play begins. Play continues on until a player having a prescribed number of player chips reaches the finish station.

DESCRIPTION OF PREFERRED EMBODIMENT OF INVENTION

Figure 1:
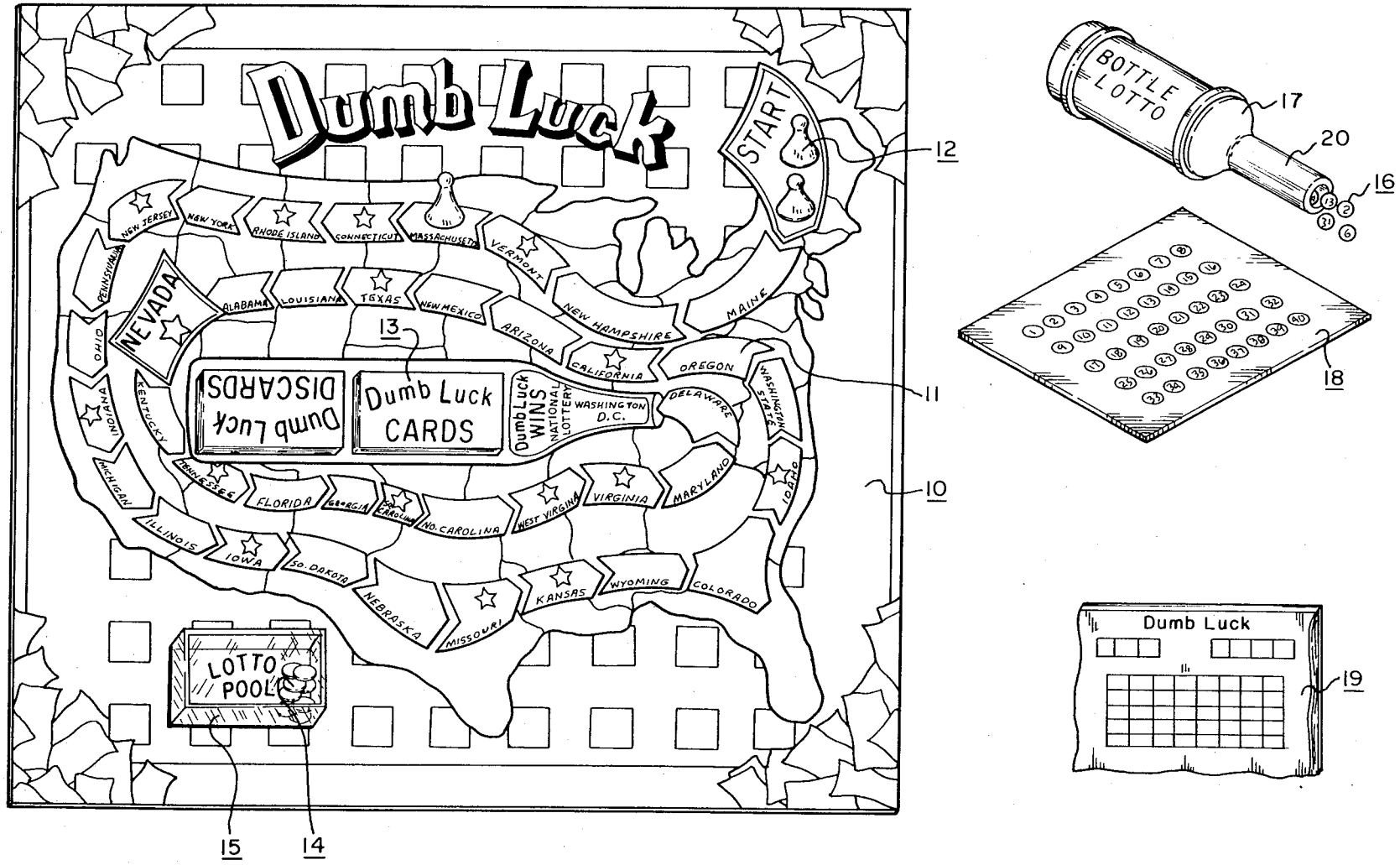
FIG. 1 is a perspective view illustrating, in combination, all of the various elements of the board game of the present invention.

A. Elements of the Game:

The various physical elements of the board game of the present invention are shown generally in FIG. 1 of the drawings. A general description of these various elements will be undertaken followed thereafter by a more detailed disclosure in the following figures of the drawings.

The board game at present mentioned includes a game board 10 having a progressive path between a start and finish station formed by a plurality of stations 11. A plurality of player markers 12 are utilized and adapted to be moved from station to station in accordance with the rules of play.

A plurality of player direction cards 13, to be described in more detail hereafter, are provided. The player direction cards 13 are stacked and placed on the board in a box labeled for the cards.

A plurality of player chips 14 are provided. The player chips 14 are positioned in a lottery pool container 15 positioned on the game board 10.

Further included as equipment for the board game of the present invention are forty lottery balls 16 consecutively numbered from one through forty. The lottery balls are maintained in a lottery ball container 17 for use in accordance with the rules of play of the game.

A lottery ball placement board 18 is provided. The lottery ball placement board 18 is adapted to receive the lottery balls when drawn from the lottery ball container 17.

Lastly, as a part of the equipment of the game board of the present invention is a plurality of lottery tickets 19. The details of these lottery tickets will be described hereinafter.

Referring further to FIG. 1 and particularly the lottery balls 16 and lottery ball container 17, the lottery balls are numbered consecutively from one through forty. More or less lottery balls could be employed as required. Additionally, the lottery balls may be of any other shape such as flat disks and the like. Also anticipated that other than numbers may be used such as letters of the alphabet.

The lottery ball container 17 is in the form of a bottle and has a neck 19 of a diameter slightly larger than that of the lottery balls 16. In this manner the lottery balls may be placed into the lottery ball container, shaken to mix the balls up and dispensed one at a time through the neck 19 of the lottery ball container 17. Any other suitable container and dispensing means may be employed.

Figure 2:
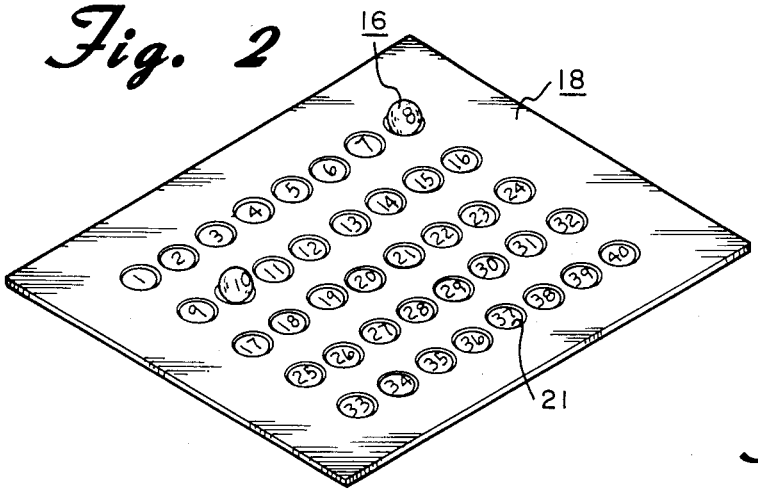
FIG. 2 is a perspective view of the lottery ball placement board of the present invention.

Referring now to FIG. 2 there is disclosed the details of the lottery ball placement board 18. The lottery ball placement board is essentially rectangular and flat. The lottery ball placement board 18 includes forty sequentially numbered lottery ball receptacles 21. During play, as a lottery ball is withdrawn as shown in receptacle number 8 in FIG. 2, the value of the lottery ball will be read and the lottery ball 16 placed in the appropriate numbered lottery ball receptacle 21. In this manner, as play proceeds, the particular lottery balls that have been withdrawn can be kept track of for later comparison to the numbers selected by the player on the lottery tickets 19 to be described hereinafter.

Figure 3:
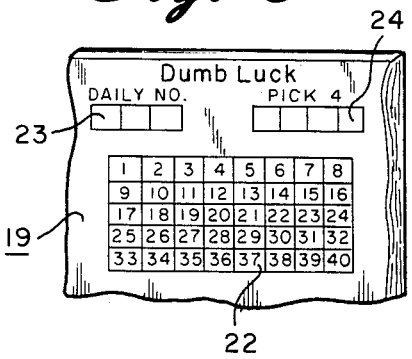
FIG. 3 is a perspective view in detail of the lottery tickets of the present invention.

The details of the lottery tickets 19 are shown in FIG. 3 of the drawings. The lottery tickets are flat pieces of paper formed into a pad. During play each player receives one of the lottery tickets.

Each lottery ticket includes a series of preprinted lottery numbers 22 which run serially from one through forty and thus equal the number of lottery balls 16. The lottery tickets 19 also include a series of three blanks 23 identified as the Daily Number and also a series of four blanks 24 identified as the Pick 4. The manner in which these blanks 23 and 24 are utilized will be described hereinafter during the rules of play.

Figure 4:
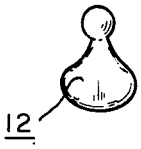
FIG. 4 is a perspective view of the player marker of the board game of the present invention.

The player markers 12 of the present invention are shown in FIG. 4 of the drawings. In a preferred embodiment there are eight player markers. Each marker is of a different color or configuration so that each player can identify his marker.

Figure 5:
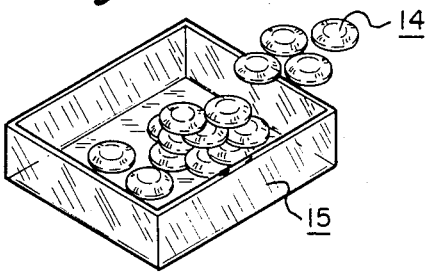
FIG. 5 is a perspective view of the player chips and lottery pool container of the board game of the present invention.

Shown in FIG. 5 are the details of the player chips and the lottery pool container 15. The player chips resemble coins and, if desired, may have printed thereon, a simulated monetary value. Any other form of chip may be utilized such as actual coins or other devices.

The lottery pool container 15 is a rectangular, shallow container. The lottery pool container 15 is adapted to retain those coins which form the lottery pool as to be described hereinafter. The lottery pool container 15 is adapted to be placed on the game board 10 as shown in FIG. 1. Any number of player chips may be utilized. It has been found that approximately 400 player chips are sufficient when utilized with eight players.

Figure 6:
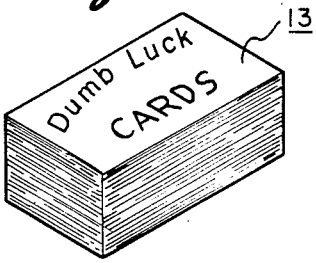
FIGS. 6 and 7 are perspective and plan views, respectively, of the player direction cards of the board game of the present invention.
Figure 7:
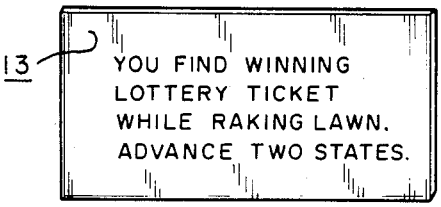

The details of the player direction cards 13 are shown in FIGS. 6 and 7 of the drawings. These cards may be any in number. Approximately eighty cards have been found sufficient when utilized with eight players.

The player direction cards each contain a different instruction. For example, as shown in FIG. 7, the instruction is "YOU FIND WINNING LOTTERY TICKET WHILE RAKING LAWN. ADVANCE TWO STATES." It is not believed necessary to repeat the language on all of the remaining player direction cards. However, each of the direction cards, with exception of two as hereinafter described, direct the player receiving the card in accordance with the rules of play to advance or return and/or receive or pay chips to or from the lottery pool or from the other players.

There are two special player direction cards in the pile of player direction cards 13. One of these special cards will state "HOLD THIS CARD, SEND PLAYER BACK TO NEVADA." The second special card reads "PAY FIVE CHIPS TO KEEP THIS CARD. USE IT TO VOID THE (SEND BACK TO NEVADA) CARD." The use and effect of these cards will be discussed hereinafter in connection with the rules of play.

Figure 8:
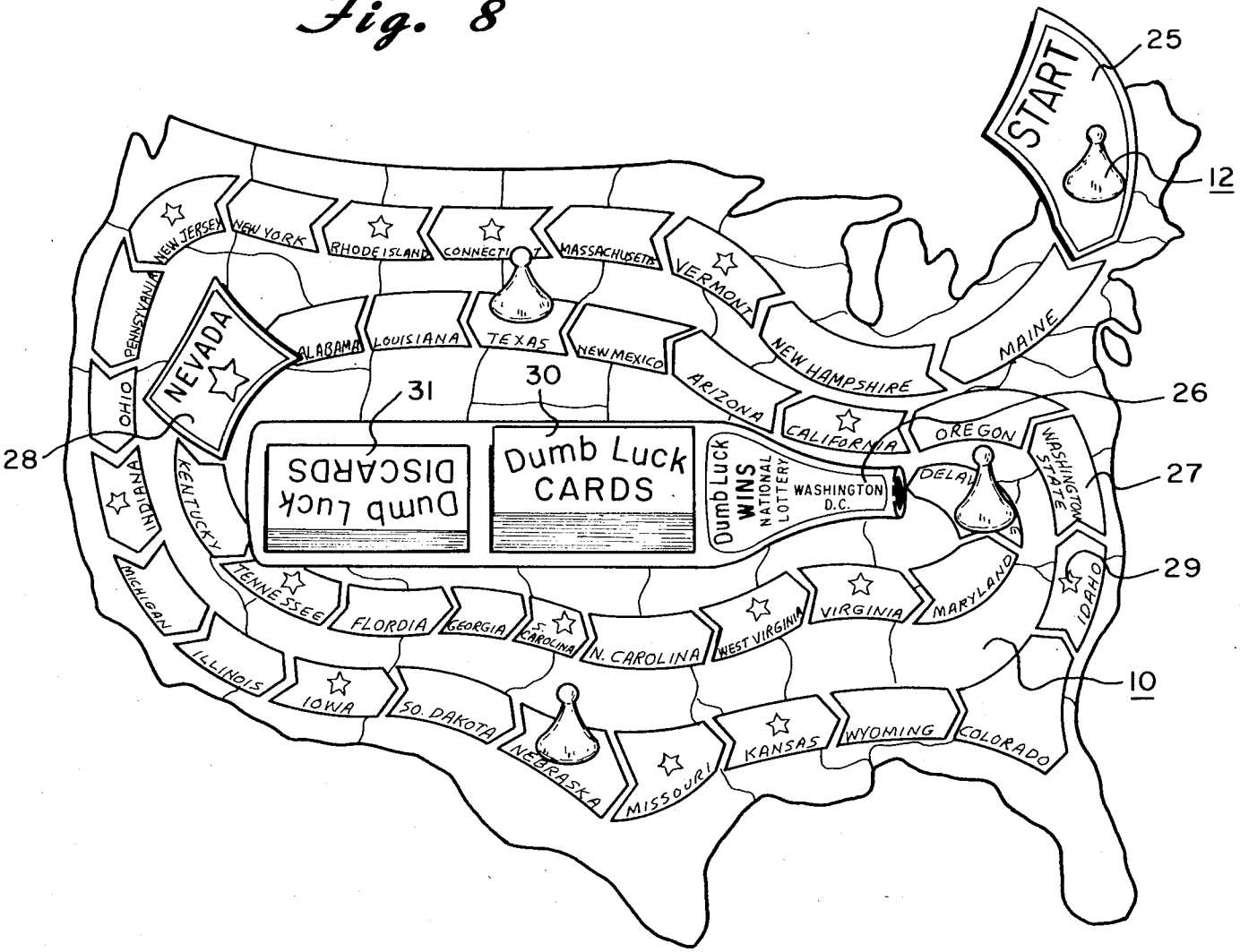
FIG. 8 is a plan view in detail of the game board layout of the board game of the present invention.

The details of the game board 10 are shown in FIG. 8 of the drawings. The game board 10 includes a starting station 25 and a finish station 26. In between the starting station 25 and the finish station 26 are forty stations 27 named after various states of the continental United States and all superimposed upon an outline of the continental United States showing the outline of the various 48 contiguous states of the nation. The forty stations 27 including the starting station 25 and finish station 26 form a path of progression upon which the player markers 12 are moved in accordance with the rules of play of the game.

One station 28 designated as Nevada is prominently displayed. The use and effect of this station will be discussed hereinafter in connection with the rules of play.

Various of these stations include a star 29 thereon. The star 29 imposes certain conditions during the play of the game enabling the player to draw a player direction card whenever that player's marker 12 rests on that station having a star 29.

The game board 10 includes a player direction box 30 and a player direction card discard box 31. During play of the game the stack of player direction cards are placed in the player direction card box 30 and pulled from the stack and read.

B. Rules of Play:

At the beginning of play the game board is placed upon a flat surface and the forty lottery balls placed in the lottery ball container. Each player selects a player marker and places his marker on the start station. The player direction cards are shuffled and placed face-down on the game board. The lottery pool container is placed on the game board. Each player is given fifty chips to commence play with. Each player is then given a lottery ticket for which he must pay six chips. All chips paid for the lottery tickets are placed in the lottery pool.

A lottery commissioner must be chosen. The lottery commissioner is the individual who will draw lottery balls from the lottery ball container and make all final judgments and decisions. The manner in which the commissioner is elected is that each player draws a ball from the lottery ball container. The player having the highest numbered lottery ball becomes the commissioner.

Each player now selects six numbers from the forty numbers on the lottery ticket by such means as circling the six numbers. Each player then also chooses three numbers in the Daily Number and four numbers in the Pick 4 blanks. The same digit cannot be used more than twice in the combined numbers for the Daily Number and Pick 4.

The play then commences with the commissioner drawing successionally balls from the lottery ball container, reading the number aloud and placing the lottery ball in the lottery ball placement board. If a player has the number called out, that particular player calls out "LOTTO" and marks it on their ticket and also moves their player marker one station or state. If more than one player calls "LOTTO" at the same time, the play will start with the person closest to the left of the commissioner and go in clockwise order. Two or more players may rest on the same station or state at the same time.

The commissioner continues drawing lottery balls from the lottery ball container calling out the number of each ball. Players move one state or station each time when one of their six selected numbers are called. When a player has all of his six selected numbers called, he will call out "PICK 6." The commissioner will verify that the six numbers have been pulled from the lottery ball container. The player then moves his marker six stations or states and collects all of the chips from the lottery pool. That player now becomes the new commissioner.

Upon a player declaring "PICK 6" the play on all of the lottery tickets ends. At this time all players must pay six chips to the lottery pool for a new lottery ticket to stay in the game. If a player does not have six chips to purchase a new lottery ticket, he may buy a ticket with the amount of chips he has remaining and stay in the game until he is required to pay chips for any reason. The consequences of running out of chips is discussed hereinafter under the rule pertaining to bankruptcy.

Whenever a player's selected numbers for the "DAILY NUMBER" or "PICK 4" have been called and verified the commissioner will pay to the player from the lottery pool that amount of chips, i.e. three chips for "DAILY NUMBER" and four chips for "PICK 4". A player does not move his player marker upon winning the "DAILY NUMBER" or "PICK 4". Upon the player winning the "DAILY NUMBER" or "PICK 4" that player shall declare "DAILY NUMBER" or "PICK 4" as the case may be.

If any other players call "LOTTO" or "DAILY NUMBER" or "PICK 4" at the same time as a Pick 6 winner, the play will continue as usual up to the last Pick 6 winner, if more than one player wins only then will play cease. In the event of more than one player declaring "PICK 6" the commissioner will verify all numbers and the pool will be distributed evenly. The new commissioner will be the winning player closest to the left of the retiring commissioner.

If a player's marker moves to a station or state having a star, then that player will take a player direction card from the top of the player direction card stack. The player will then follow the instructions on the card. If the direction requires payment or receipt of payment, the same will go to or be received from the lottery pool unless that card states that the payment to or receipt of payment from is to be from the other players. If the player direction card directs movement from another station or state and that state also has a star on it, the player then will draw another card and likewise follow the instructions as before. Whenever the player direction cards are exhausted, they are reshuffled and placed back onto the game board.

One player direction cards reads "HOLD THIS CARD", SEND LEADER BACK TO NEVADA." Whenever a player draws this card, he may either discard the card or pay ten chips to the lottery pool for the card. If the card is retained, the player may use the card immediately or may hold onto it and use it whenever one of his Pick 6 numbers is called. Whenever the card is used, the player can designate the leader to return their player marker back to the Nevada station or state. The player direction cards also include one card entitled "PAY FIVE CHIPS TO KEEP THIS CARD." Use it to void the "SEND BACK TO NEVADA." Whenever a player draws this card, he must pay five chips to the lottery pool to retain the card. The player retaining this card will then be immune from being sent back to Nevada by the player holding the "HOLD THIS CARD, SEND PLAYER BACK TO NEVADA" card.

Any player who loses all of their chips and cannot pay their debts except to purchase a new lottery ticket as stated before is automatically out of the game. However, if that player has the "HOLD THIS CARD, SEND LEADER BACK TO NEVADA" card, he may sell the card to any other player under a bidding arrangement and stay in the game. If there are no bidders, that particular player must return the "HOLD THIS CARD, SEND LEADER BACK TO NEVADA" card to the discard pile and leave the game.

Bids for the "HOLD THIS CARD, SEND LEADER BACK TO NEVADA" card are taken by the bidding player writing the amount of their bid on the back of their lottery ticket and secretly showing the amount of the bid to the commissioner. The commissioner may bid by placing his bid on his lottery ticket prior to seeing the other players' bids. The commissioner will award the card to the highest bidder who will then pay the amount of his bid to the player holding the card.

Whenever a player reaches the finish station entitled "Washington, D.C.," he calls out "DUMB LUCK". If that player has twenty chips or more upon reaching Washington, D.C. he is declared the winner. A winner collects all of the chips in the lottery pool and also collects six chips from each player. At that point the game is over.

If the player reaching Washington, D.C. does not have twenty chips, he must return to Nevada and proceed from there hoping to collect the required amount of chips to win upon reaching Washington, D.C. If more than one player reaches Washington, D.C. at the same time, those players will divide the winnings equally.

While the foregoing describes a preferred embodiment of the board game of the present invention, it is to be understood by those skilled in the art that various changes may be made therefrom without departing from the broad scope and spirit of the invention as defined in the claims.

What is claimed is:

1. Game board apparatus of chance for play by a plurality of players comprising:

a game board having a path of progression formed of a series of stations between a starting station and a finish station;

a plurality of player markers adapted to be positioned and moved from station to station along the path of progression in accordance with the rules of play of the game;

first chance-taking means including a plurality of one of a kind individually unique indicia providing random individual one time selection thereof; and player indicia selection means permitting each player to individually select a prescribed number of individually unique indicia whereby repeated play of the first chance-taking means produces a series of randomly selected one of a kind individually unique indicia to ultimately match each of the prescribed number of individual indicia chosen by a given player to produce a condition of winning for that player in the nature of a lottery in accordance with the rules of play of the game.

2. The game board means of claim 1 further including second chance-taking means providing a plurality of player directions to be followed by a given player upon the occurrence of a given condition occurring in accordance with the rules of play.

3. The game board apparatus of either of claims 1 or 2 further including a plurality of player chips adapted to be initially distributed to each player in a predetermined number and exchanged between players and/or a lottery pool in accordance with the rules of play.

4. The game board apparatus of claim 3 wherein the player indicia selection means includes a lottery card for each player bearing each of the plurality of individually unique indicia from which the player can select and mark the prescribed number of individually unqiue indicia.

5. The game board apparatus of claim 4 wherein the lottery card further includes blank portions thereon in which a player can mark a selection of a further prescribed number of individually unique indicia to be matched during play.

6. The game board apparatus of claim 3 wherein the first chance-taking means includes a plurality of serially numbered chance pieces.

7. The game board apparatus of claim 6 wherein the first chance-taking means further includes a chance piece container for displaying the chance pieces and dispensing means for dispensing these chance pieces one at a time.

8. The game board apparatus of claim 7 wherein the first chance-taking means further includes a chance piece placement board having a plurality of individual areas each serially numbered to correspond to the plurality of chance pieces and adapted to receive the chance pieces as randomly selected to provide visual verification of the chance pieces selected.

9. The game board apparatus of either of claims 1 or 2 wherein the player indicia selection means includes a lottery card for each player bearing each of the plurality of individually unique indicia from which the player can select and mark the prescribed number of individually unique indicia.

10. The game board apparatus of claim 2 wherein selected ones of the series of stations include indicia prompting play of the second chance-taking means by a given player upon that player's marker following such a selected one of the series of stations.

11. The game board apparatus of either of claims 2 or 10 wherein the second chance-taking means includes cards having the player directions printed.

* * * * *